US008186668B2

(12) United States Patent
Wardak et al.

(10) Patent No.: US 8,186,668 B2
(45) Date of Patent: May 29, 2012

(54) STACK FEEDING AERATION DEVICE AND METHOD

(75) Inventors: Andreas Wardak, Rottweil (DE); Peter Xavier Kearney, Fridingen (DE)

(73) Assignee: BDT AG, Rottweil (DE)

( * ) Notice: Subject to any disclaimer, the term of this patent is extended or adjusted under 35 U.S.C. 154(b) by 0 days.

(21) Appl. No.: 12/900,029

(22) Filed: Oct. 7, 2010

(65) Prior Publication Data

US 2012/0086163 A1 Apr. 12, 2012

(51) Int. Cl.
*B65H 3/14* (2006.01)

(52) U.S. Cl. ..... 271/97; 271/98

(58) Field of Classification Search ..... 271/97, 271/98

See application file for complete search history.

(56) References Cited

U.S. PATENT DOCUMENTS

| | | | |
|---|---|---|---|
| 3,847,383 | A | 11/1974 | Wojtowicz et al. |
| 4,368,973 | A | 1/1983 | Silverberg |
| 4,643,413 | A | 2/1987 | Ward |
| 4,822,022 | A | 4/1989 | Attenasio |
| 5,090,676 | A | 2/1992 | Matsuno et al. |
| 5,110,110 | A | 5/1992 | Wirz et al. |
| 5,232,213 | A | 8/1993 | Parsons et al. |
| 5,645,274 | A | 7/1997 | Ubayashi et al. |
| 5,671,920 | A | 9/1997 | Acquaviva et al. |
| 5,893,554 | A | 4/1999 | Okahashi et al. |
| 6,015,144 | A | 1/2000 | Yoshii et al. |
| 6,082,728 | A | 7/2000 | Ubayashi |
| 6,120,016 | A | 9/2000 | Watkiss |
| 6,497,553 | B2 | 12/2002 | Illingworth et al. |
| 6,565,321 | B1 | 5/2003 | Illingworth et al. |
| 6,595,753 | B1 | 7/2003 | Illingworth et al. |
| 6,729,614 | B2 | 5/2004 | Okazaki et al. |
| 6,729,839 | B1 | 5/2004 | Illingworth et al. |
| 7,204,672 | B2 | 4/2007 | Sewell |
| 7,364,150 | B2 | 4/2008 | Nakane |
| 7,841,591 | B2 * | 11/2010 | Ueda et al. ..... 271/98 |
| 7,913,993 | B2 | 3/2011 | Kosugi et al. |
| 2004/0089994 | A1 | 5/2004 | Koga et al. |
| 2005/0133980 | A1 | 6/2005 | Koga |
| 2008/0237968 | A1 | 10/2008 | Suzuki |

(Continued)

FOREIGN PATENT DOCUMENTS

DE 102007022700 A1 11/2008

(Continued)

OTHER PUBLICATIONS

Co-pending U.S. Appl. No. 12/775,522, filed May 7, 2010 entitled "Vortex Suction Separator Device".

(Continued)

*Primary Examiner* — David H Bollinger
(74) *Attorney, Agent, or Firm* — Leydig, Voit & Mayer, Ltd.

(57) ABSTRACT

An aeration device adapted to aerate one or more sheets of a stack of sheets includes a side blower configured to selectively provide an air stream at an outlet thereof along an airstream direction so as to impinge against at least a portion of the stack. A height detecting device is configured to detect a height of an uppermost sheet of the stack. A side blower adjustment device is configured to adjust a height of the side blower and/or an angle of the airstream direction so as to track, by the air stream, the uppermost sheet of the stack based on an input from the height detecting device.

28 Claims, 9 Drawing Sheets

U.S. PATENT DOCUMENTS

| | | | | |
|---|---|---|---|---|
| 2009/0127768 | A1 | 5/2009 | Shima et al. | |
| 2010/0148419 | A1 * | 6/2010 | Suzuki | 271/3.11 |

FOREIGN PATENT DOCUMENTS

| | | | |
|---|---|---|---|
| EP | 1975735 | A1 | 10/2008 |
| GB | 2295799 | A | 7/1996 |
| GB | 2343879 | A1 | 5/2000 |
| JP | 62016947 | A | 1/1987 |

OTHER PUBLICATIONS

Co-pending U.S. Appl. No. 12/717,505, filed Mar. 4, 2010, entitled "System for conveying an article using vortex suction units".

European Patent Office, International Search Report in International Patent Application No. PCT/IB2011/002345 (Feb. 23, 2012).

* cited by examiner

STACK FEEDING AERATION DEVICE AND METHOD

BACKGROUND

Various industrial applications require the selective picking of sheets from a stack to feed a machine or process, such as sheets of paper for printing presses, sheets of metal for punch presses, plastic sheets for laminating machines, and the like. The process of retrieving sheets from a stack is commonly referred to as stack feeding. When feeding flat flexible substrates form a stack, one issue that commonly arises is adhesion between the individual sheets, and especially adhesion of the topmost sheet with one or more sheets that are below it in the stack. Such adhesion, which may impair the separation of the uppermost sheet from a second or even several additional sheets, as the topmost sheet is picked from the top of the stack for insertion into a machine or process, is an undesired issue that is commonly referred to as multi-picking.

The adhesion between sheets that can create issues for stack feeding applications is typically the result of one or more factors, such as the weight of the sheet substrates, friction between the sheets, static electrical charges of the sheets, which is an especially predominant factor for glossy and coated sheets, and other factors.

Various solutions have been proposed in the past to aid sheet separation in stack feeding applications. In one previously proposed solution, ventilation of the top few sheets of the stack is used to separate the sheets by a thin layer of air. In this solution, the sheets are ventilated by injection of an air stream between sheets lying on the top of the stack. The injection of air may be accomplished by a fan or a compressor that is configured to provide an air stream onto the desired area of the stack. Alternatively radial or axial fans have been used in the past to provide the air stream, which is then delivered to the top of the stack by use of ducts and guides.

Although known ventilation arrangements are at least partially effective in providing separation between sheets, these known devices are heavy, expensive, and not particularly capable in providing consistent sheet separation when the stack height is being reduced as sheets are removed. Moreover, the ducts and other devices used to direct and deliver the air stream cause losses in the air delivery system for the stream and are not easily adaptable to various stack heights or for larger sheets.

One example of a known sheet separation arrangement for a stack feeding process can be seen in U.S. Pat. No. 6,729,614 (the '614 patent), which is entitled "Sheet Feeding Apparatus." The '614 patent describes (see, for example, FIGS. 1(a) and 1(b)) a roller based feeding system. The roller based feeding system includes side blowers having a fixed position relative to a stack for providing a stream of air between sheets that separates the sheets. The side blowers include radial fans and diverters to route the stream of air towards the stack. In the illustrated embodiment, the stream of air is bent by over 90° via nozzles, which direct the stream towards the side walls of the sheets. Adjustments to the position of the topmost sheet in the stack relative to the blowers as sheets are removed from the stack is accomplished by a lift table, which is configured to raise the stack as sheets are removed from the top of the stack.

An additional known example of a sheet separation arrangement can be seen in U.S. Pat. No. 6,015,144 (the '144 patent), which is entitled "Sheet Feeder and Image Forming Apparatus." In one embodiment, the '144 patent describes a roller based sheet feeder that uses side blowing means providing an air stream through a side wall of a tray containing the stack (see, for example, FIGS. 28A-28C). The air is supplied by a blower or fan that is fixed to the side wall of the tray. The devices disclosed in the '144 patent further include air regulation members that can direct the air stream to a desired location in the stack from the fixed-position blower or fan. Moreover, insofar as the position of the blower is fixed, either the air regulation members or the height of the stack must be continuously adjusted to accommodate the removal of sheets from the stack.

Use of air to separate sheets also requires structures that prevent the topmost sheet or sheets of a stack to fly out of position prior to being picked. For this reason, each of the structures disclosed in the '614 and '144 patents includes a flotation suppression member ensuring that the upper sheet is not blown off.

The solutions proposed by the '614 and '144 patents are not well suited at least for larger sheet sizes such as ISO standard sheet sizes B2 (500×707 mm), A2 (420×594 mm), A0 (841×1189 mm), or other larger formats. Such large formats, besides being large (having a surface area of up to 1 $m^2$), may also have a considerable weight of up to 400 gr. per sheet or more. Therefore, the dual fixed position blowers employed by the structures of each of the '614 and '144 patents would be inadequate to provide the necessary air cushion that can keep the upper sheets of the stack floating while still being compact enough and practical for use in stack feeding machines. Further, even if the dual blowers were configured to provide sufficient air flow to lift multiple large sheets from the top of the stack, the increased air flow would likely cause multiple sheets to concentrate below the respective floatation suppression members, which would likely impair sheet separation and cause multi-picks as the concentrated sheets would cling together.

In general, sheet aeration by means of several fixed blowers is known to cause uneven sheet separation insofar as while one part of a sheet closest to the blower may be blown upwards by the blower, other parts of the same sheet disposed away from the blower may be blown downwards by portions of the air stream passing over the sheet, which at least inhibits the creation of a consistent air cushion between the sheets.

An additional example of a previously proposed solution can be seen in DE 102007022700 A1, which in one embodiment describes a blower having a motor-driven impeller wheel that provides an air stream for aerating the side of a stack of sheets in various feeding systems. The blower is positioned at the side of the substrate stack such that the air stream is blown towards to the upper portion of the stack. The blower is connected to a feeding arm that continuously adjusts the position of the blower to be adjacent the top of the stack as sheets are removed.

Therefore, although some previously proposed solutions include sheet separation by aeration, none is capable of automatically adjusting the position of the air stream supply for compensation of the wavelike movement of the inflated sheets, which can cause multi-picks or other stack feeding issues.

SUMMARY

In one aspect, the disclosure describes an aeration device adapted to aerate one or more sheets of a stack of sheets. The aeration device includes a side blower configured to selectively provide an air stream at an outlet thereof along an airstream direction so as to impinge against at least a portion of the stack. A height detecting device is configured to detect a height of an uppermost sheet of the stack. A side blower adjustment device is configured to adjust a height of the side blower and/or an angle of the airstream direction so as to track, by the air stream, the uppermost sheet of the stack based on an input from the height detecting device.

DETAILED DESCRIPTION

In an embodiment, the invention provides an aeration device adapted to aerate one or more sheets of a stack of sheets includes a side blower providing an air stream that impinges the stack. A height detecting device is configured to detect a height of an uppermost sheet of the stack. In one embodiment, a dampening and stabilizing device is also used to inhibit the uppermost sheets from being blown off by the side blower and to dampen an undulating motion of the uppermost sheet during operation. A height adjustment device is associated with the side blower and controlled by a side blower height detecting device associated with the side blower. A control regulating device may be included with the side blower height detecting device to regulate a height of the blower based on a signal provided by the height adjustment device. In this way, a height of a center of the air stream is disposed to track an edge of the uppermost sheet of the stack.

Figure 1:
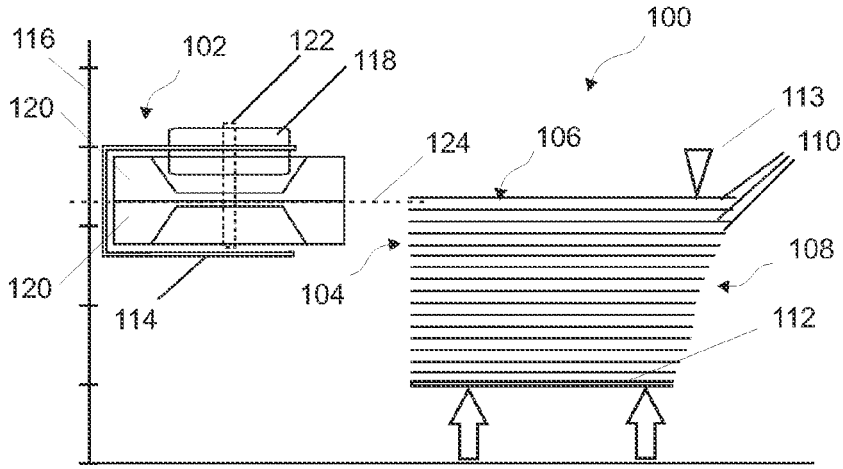
FIGS. 1-4 are side views of a first embodiment of a stack feeding aeration device at different operating conditions in accordance with the disclosure.

In the description that follows, elements or features that are the same or similar as corresponding elements and features already described are denoted by the same reference numerals in the several views of the drawings and in the description for simplicity. Accordingly, a first embodiment of a stack feeding aeration device 100 is shown in FIGS. 1-4. As shown in FIG. 1, a side blower 102 is mounted adjacent a side portion 104 of an upper part 106 of a stack 108. The stack 108 is made up from a plurality of sheets 110 and is disposed on a lift table 112 that is configured to selectively lift the stack 108 as sheets 110 are removed from its upper part 106. A stack height sensor 113 is disposed to sense and provide a signal indicative of the height of the topmost sheet 110 of the stack 108.

Figure 2:
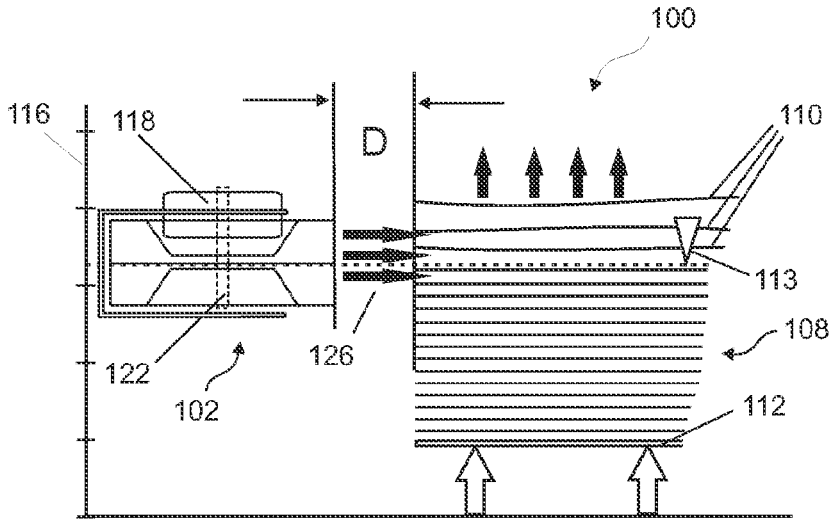

In the illustrated embodiment, the blower 102 includes a frame or housing 114 that is connected to a vertical support member 116. The frame 114 supports a motor 118 that drives dual radial fans or impellers 120 that rotate on a motor or impeller shaft 122. A shown, the impeller shaft 122 is disposed perpendicularly to a plane 124 that coincides with a plane defined by the upper part 106 of the stack 108. A distance, D, as shown in FIG. 2, which separates the outlet of the side blower 102 may be adjusted depending on the size and weight of the sheets 110 being fed. For example, the distance D may be selected to be between 5 to about 50 mm for most common sheet sizes, with other distances selected if required based on the size, stock thickness, or type of material of the sheets.

When the side blower 102 is active, as shown in FIG. 2, it provides an air stream 126, which in the figures is denoted by solid arrows. The airstream 126 is directed towards the upper part 106 of the stack 108 and operates to ventilate one or more of the sheets 110 of the stack 108. Given a flow rate and velocity of the air stream 126 that is sufficient based on the size and weight of the sheets, the air stream 126 will inflate a plurality of the sheets 110 disposed on the upper part 106 of the stack 108. In this way, the contact area between adjacent sheets 110 that are subjected to the air stream 126 will be substantially reduced such that adjacent sheets 110 will only be in contact with one another occasionally because of the undulating movement of the air stream.

The flow rate and velocity of the air stream 126 may be adjusted by appropriately providing a signal to the motor 118 that determines a desired rotational speed of the impellers 120 as well as by setting the distance D. In the event the air stream 126 is insufficient to adequately suspend the sheets 110, the sheets 110 may adhere to one another thus creating issues in the stack feeding process. A sufficient air stream 126 will provide proper ventilation of the sheets 110 such that they are sufficiently suspended above the stack 108, as shown in FIG. 2.

Figure 3:
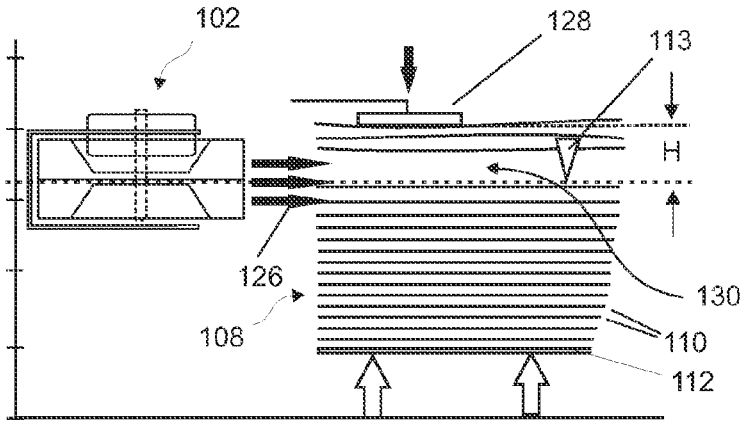

To avoid the sheets 110 being blown away and to avoid excessive flapping due to the undulating nature of the air stream 126, a height limiting part or arrestor pad 128 is disposed above the stack 108 such that the upward movement of the suspended sheets 110 at the upper part 106 of the stack 108 is limited to a predetermined height, H. As shown, the predetermined height H is disposed above the plane 124, which substantially coincides with the center of the air stream 126 when the blower 102 is active. During this operating condition, when sheets 110 are suspended and at least the uppermost sheet 110 abuts the arrestor pad 128, a plurality of the suspended uppermost sheets 110 may become concentrated below the arrestor pad 128 while temporarily and transitionally tending to leave a gap 130 between them and the remaining sheets 110 of the stack 108, as shown in FIG. 3.

Figure 4:
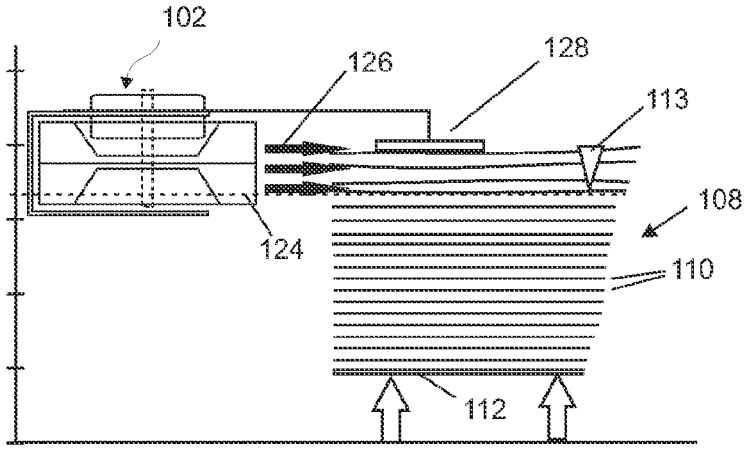

In such transitional or temporary conditions, the blower 102 is caused to move upwards while the height H of the arrestor pad 128 remains substantially unchanged. The upward motion of the blower 102 will cause a shift in the position of the air stream 126, which will in turn restore the balance and consistent cushioning of the suspended sheets 110, as shown in FIG. 4 where the relative position of the blower 102 relative to the plane 124 can be compared to that shown in FIG. 3.

Figure 5:
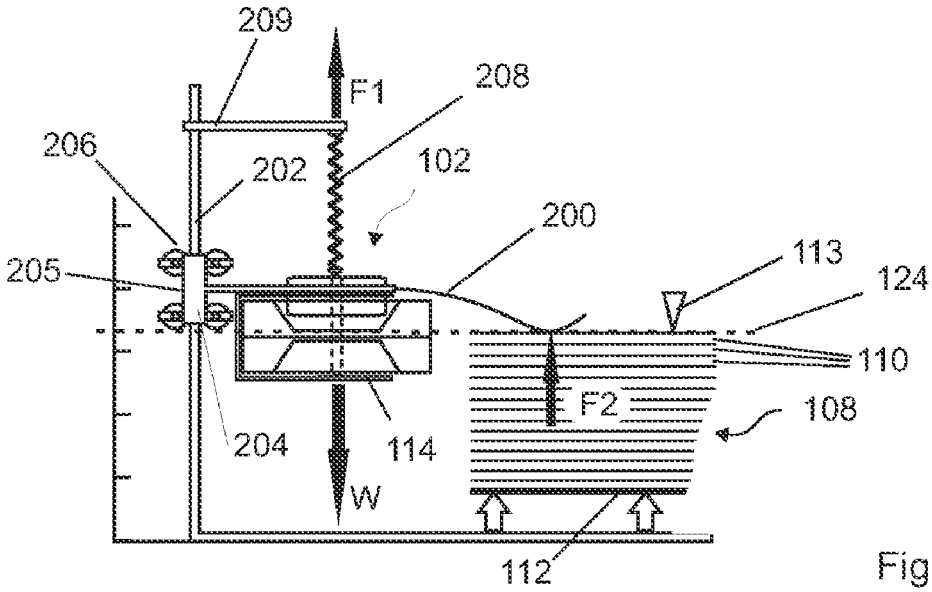
FIGS. 5-7 are side views of a second embodiment of a stack feeding aeration device at different operating conditions in accordance with the disclosure.

To accomplish this selective repositioning of the blower 102 that provides consistent spacing and ventilation of the suspended sheets 110 without creating the gap 130 (FIG. 3), a sensor lever 200 is used in one disclosed embodiment, as shown in FIG. 5. As is described in further detail in the paragraphs that follow, the sensor lever 200 is configured to sense and further regulate the height of the uppermost sheet 110 relative to the remaining sheets 110 of the stack 108 as well as relative to the height of the blower 102 with respect to the uppermost sheet 110 and to the stack 108. In the embodiment of FIGS. 3 and 4, the role of the sensor lever 200 may be fulfilled by the arrestor pad 128. In other words, the sensor lever 200 as shown in FIG. 5 also serves as a height limiter that can retain the uppermost sheet 110 from being blown away.

Figure 6:
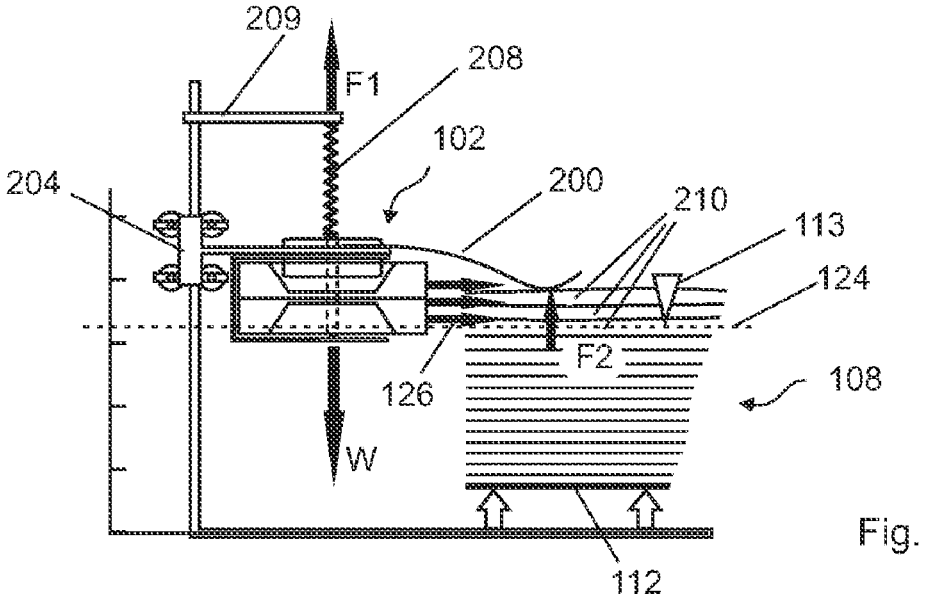
Figure 7:
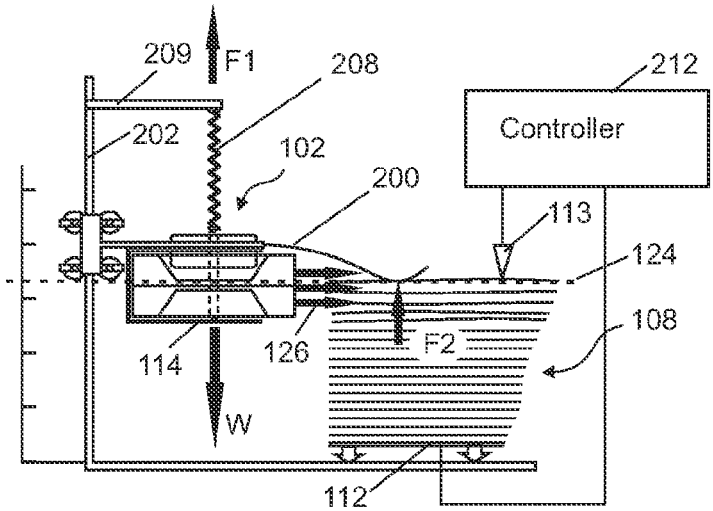
Figure 12:
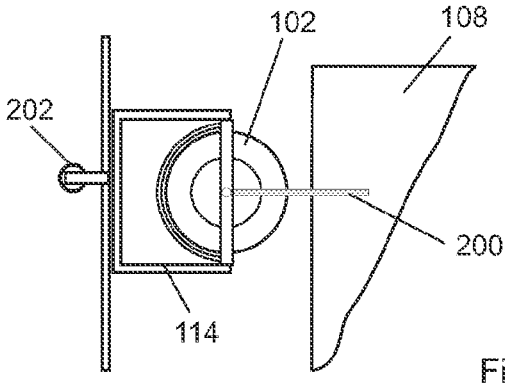
FIG. 12 is a top view of a device in accordance with the disclosure.

More particularly, and in reference to FIGS. 5-7, the sensor lever 200 has an elongate cross section that is connected to the blower frame 114 body at one end. A second, free end of the lever 200 is cantilevered away from the blower 102 and is configured to rest on top of the uppermost sheet 110 of the stack 108. In one embodiment, as shown, for example, in FIG. 12, the lever 200 may have a relatively narrow width and be positioned at approximately the middle of the blower 102. Moreover, as can be best seen in FIG. 5, the lever 200 is arranged to cantilever away from the blower 102 and is curved such that it vertically positions the uppermost sheet 110 approximately at the middle of the blower's 102 outlet height.

In the illustrated embodiment, each of the two impellers 120 of the blower 102 is a radial fan that is driven by the motor 118 at a high rate of rotation, for example, at about 15,000 to 20,000 revolutions per minute (RPM). Although two impellers 120 are shown, one or more than two impellers may be used. Further, it should be appreciated that the positioning of the blower 102 adjacent to the stack 108 obviates the need for additional ducts or other air stream directing devices.

In the embodiment of FIGS. 1-4, the blower 102 is selectively slidable along the vertical member 116 such that its height may be adjusted to correspond to the desired location of the uppermost sheet 110 of the stack 108. In a more particular illustration, the embodiment shown in FIGS. 5-7 illustrates one possible mechanism for effecting the vertical translational motion of the blower 102. More particularly, the blower 102 may connected to a vertical rod 202 via a low-friction gliding element, for example, a Teflon® bushing, or, as shown, by a vertical trolley 204. The vertical trolley 204 may include a collar 205 configured to slide along the rod 202 but that is also constrained from rotating relative thereto, for example, by a key feature (not shown). The smooth and linear motion of the trolley 204 may be augmented by a set of rollers 206 that ride along the rod 202 and ensure proper alignment and low friction in the relative motion between the trolley 204 and the rod 202. The trolley 204 is connected to the blower frame 114 such that the entire blower 102 may slide along the rod 202 while maintaining its horizontal orientation and radial orientation relative to the axis of the rod 202. The range of travel of the trolley 204 relative to the rod 202 may be selected to be appropriate for each application. In the illustrated embodiment, given the vertical motion potential of the lift table 112, the trolley 204 is arranged to have a limited travel of about 20 mm but any other travel distance may be used. In this instance, the limited travel of the trolley 204 depends on the consistency of the force of spring 208 when being extended or compressed. In this way, it should be appreciated that the travel distance of the trolley may also be adjusted when springs are replaced or changed. For example, when replacing the variable spring force F1 by a constant power force, such as a constantly powered DC Motor as a power source F1, the height of the stack can be infinitely selected and the blower moved to adjust its position relative to the stack as the stack sheets are consumed. In the illustrated embodiments, a lift table is used instead of other height regulating mechanics for the separating device, such that height adjustments may be made less frequently.

In the embodiment shown in FIGS. 5-7, a tension spring 208 is disposed between the blower frame 114 and a support member 209 disposed vertically above the blower 102 on the rod 202. The support member 209 extends away from the rod 202 such that it is positioned above the blower 102. The tension spring 208 provides a force, F1, which at least partially counteracts a downward force W provided by the weight of the blower 102. A remaining portion of the weight W of the blower 102 is counteracted by a reactionary force, F2, which is provided between the lever 200 as it rests on top of the stack 108. In this way, the blower 102 may be suspended slidably on the rod 202 while still being free to track the height of the stack 108 without imparting an excessive force on the stack 108.

The resulting force F2 may be adjusted depending on the type and weight of the sheets 110, based on the weight W and by appropriately selecting the tension spring 208 to counteract the weight W by the spring force F1 by a desired extent, thus leaving a predetermined portion of the weight W to be counteracted by the force F2. During operation, when sufficient sheets 110 have been removed from the stack 108, the height sensor 113 sends a signal to a controller (not shown) that causes the lift table 112 to lift the upper part 106 of the stack 108 to the feeding level (the plane 124). The upward displacement of the stack 108 will cause an upward displacement of the blower 102 as the top of the stack 108 touches and pushes on the lever 200, which is connected to the blower 102 and thus pulls the blower 102 in an upward direction along the rod 202, as shown in FIG. 5.

When the motor 118 is activated, a plurality of the topmost sheets 110 of the stack 108 are aerated and thus an air cushion 210 is created between individual sheets, as shown in FIG. 6. The several air cushions 210 between the sheets 110 will raise the height of the topmost sheet 110 above the plane 124, which will also raise the lever 200 and thus the blower 102 relative to the plane 124. The extent to which the blower 102 will be raised in this fashion can depend on various parameters, including the magnitude of the contact force F2 between the lever 200 and the top of the stack 108.

The force F2 may be selected to be sufficiently low to enable the air cushion 210 to raise the topmost sheet 110 to a desired height. Thus, the tension spring force F1 at a particular extension of the tension spring 208 can be selected and balanced so that nearly all the weight W of the blower 102 is born by the tension spring 208. Thus, when the blower 102 is active, a balance of the vertical forces is reached when the vertical component of the aeration force F2 between the sheets 110 along with the suspension force F1 of the tension spring 208 is about equal to the weight force W of the blower 102 and/or other components connected to the blower 102, such as the vertical trolley 204.

As the upper part 106 of the stack 108 transiently increases in height as shown in FIG. 6 following the activation and raising of the blower 102 due to the aeration of the sheets 110, the topmost sheet 110 may exceed the height of the plane 124, which also represents the nominal feeding level for a feeder device (not shown). In this condition, a correction may be made to bring the level of the inflated height of the topmost sheet 110 back down to substantially match the plane 124 by lowering the table 112, as shown in FIG. 7, based on the height or stack level signal provided by the height sensor 113. In this embodiment, the lowering of the table 112 will also cause a corresponding lowering of the blower 102.

In the embodiment shown in FIG. 7, the selective raising and lowering of the table 112 is accomplished by an appropriate actuator (not shown) that is disposed to raise or lower the table 112 in response to a command signal from the an electronic controller 212 that is operatively associated therewith. The controller 212 is also operatively associated with the height sensor 113 and disposed to receive a signal therefrom indicative of the height of the topmost sheet 110 of the stack 108 relative to the position of the sensor 113.

When the process of selectively retrieving sheets 110 from the stack 108 is underway, a feeding head is used to successively retrieve single sheets from the top of the stack 108. One example of a feeding head for selectively retrieving sheets from a stack can be found in U.S. patent application Ser. No. 12/775,522, which is entitled "Vortex Suction Separator Device," the contents of which are incorporated herein in their entirety by reference. The device described in the aforementioned application includes a vortex suction unit disposed on a mounting assembly facing the stack that is configured to retrieve and convey an article from the stack. As sheets 110 are removed from the top of the stack 108 in this or any other suitable fashion, the stack height will decrease until a low threshold height is reached. When the low threshold height is reached, the height sensor 113 will provide a signal to the controller 212 that will cause the lift table 112 to raise the stack 108 to the predetermined feeding height. The raising of the stack 108 will also cause the blower 102 height to increase, as previously described, to follow the upper part 106 of the stack 108. As can be appreciated, the blower 102 may incrementally be lowered as sheets are removed from the stack 108. In this way, the stack feeding process may continue substantially uninterrupted while the feeding process continues and the stack 108 has not been depleted of sheets.

Figure 8:
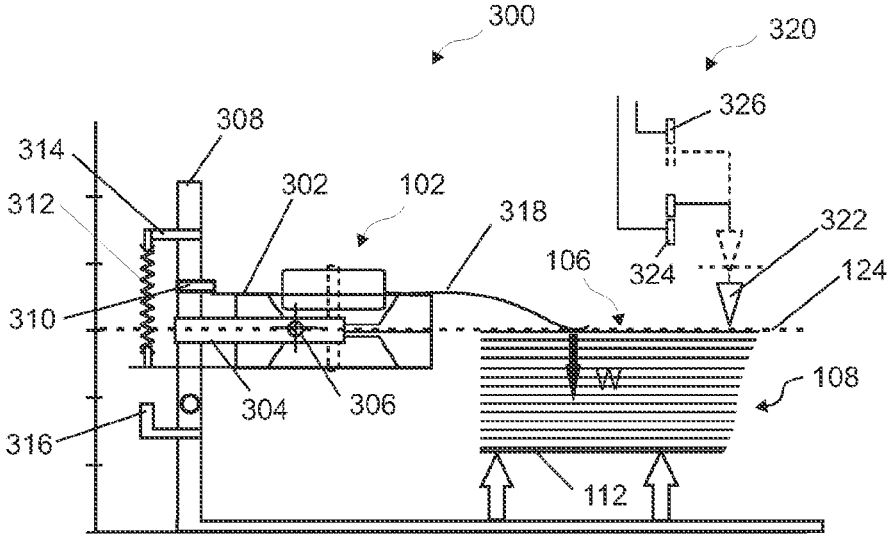
FIGS. 8-10 are various views of a third embodiment of a stack feeding aeration device in accordance with the disclosure.
Figure 9:
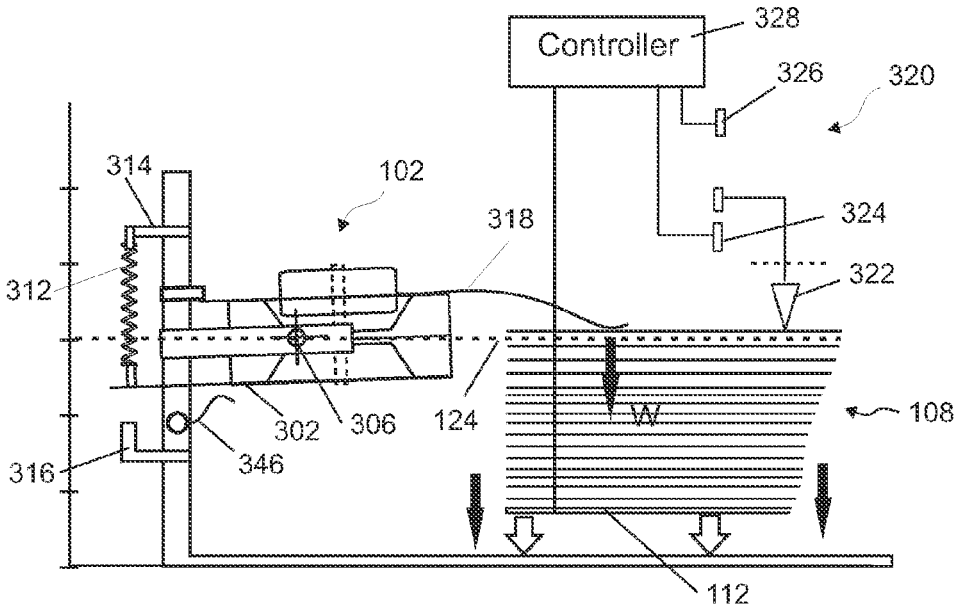
Figure 10:
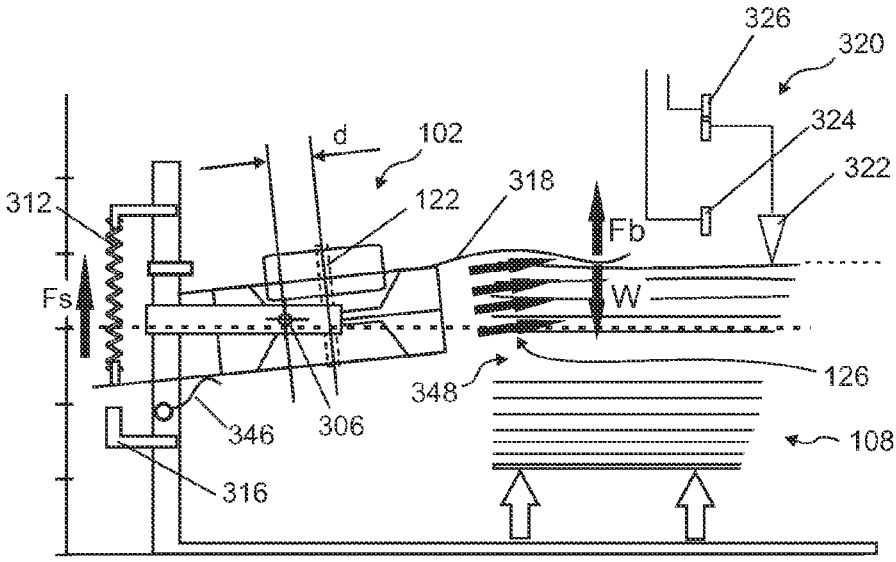

An alternative embodiment of an aerating device 300 is shown in FIGS. 8-10. In this embodiment, an alternative mounting arrangement configured for tilting motion of the blower 102 is illustrated and described. As is best shown in FIG. 8, the blower 102 is mounted on a tilting frame 302 that is pivotally connected to a support member 304 at a pin joint 306. The pin joint 306 is disposed at a radial distance, d, from the impeller shaft 122 and lies along the plane 124. In this embodiment, the plane 124 coincides with the middle of the blower 102 when the blower 102 is substantially horizontal as shown in FIG. 8.

The support member 304 is connected to a vertical support pole 308 which further includes a stop 310 arranged to arrest the rotatable frame 302 in a horizontal position, as shown in FIG. 8. A tension spring 312 connects a portion of the frame 302 with an upper hanger 314 that is connected to the pole 308. The tension spring 312 is disposed to extend when the blower 102 tends to rotate in a counterclockwise direction when viewed from the perspective shown in the drawings, as shown, for example, in displaced condition in FIG. 10. Although the tension spring 312 is one example of a resilient element, other structures may be used such as compression springs and rotary springs, or selectively activatable rotary actuators may alternatively be used.

The angular displacement of the blower 102 relative to the pole 308 is limited by the stop 310, as shown in FIG. 8. A maximum angular displacement position of the blower 102 is limited by a lower bumper 316. The lower bumper 316 is connected to the pole 308 and is arranged to abut the extension of the frame 302 that supports the lower end of the tension spring 312 when the frame 302 is sufficiently deflected.

A lever 318 having a substantially elongate shape is connected to the blower 102 on at one end. A second, free end of the lever 318 extends away from the blower 102 and is configured to touch the topmost sheet 110 at the upper part 106 of the stack 108. The aerating device 300 further includes a step height sensor 320 having a sensing element 322 that is vertically displaceable such that a low level switch 324 and a high level switch 326 may be activated. As shown, the sensing element 322 tracks the position of the uppermost sheet 110 of the stack 108. When the height of the topmost sheet 110 is sufficiently low, the low level switch 324 provides a signal to a controller 328 (FIG. 9). Correspondingly, when the height of the topmost sheet 110 is sufficiently high, the high level switch 326 is activated to provide an appropriate signal to the electronic controller 328.

Figure 11:
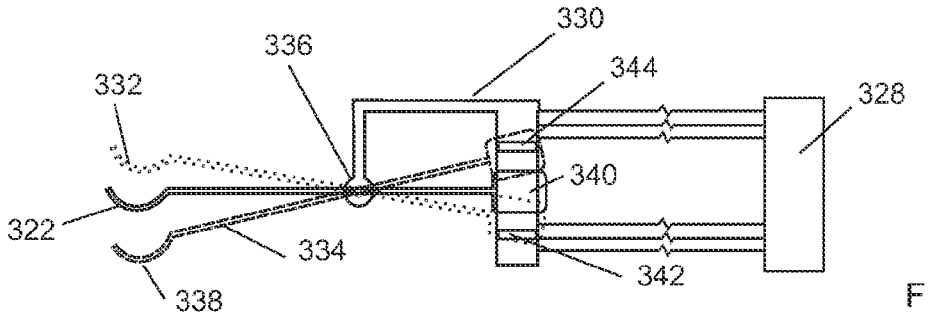
FIG. 11 is a detail view of a level switch in accordance with the disclosure.

A detail view of one embodiment of the step height sensor 320 is shown in FIG. 11. As shown, the step height sensor 320 includes a sensor wand as the sensing element 322 that is pivotally connected to a support structure 330, as shown in FIG. 10. Although a contacting sensor is shown and described relative to this embodiment, non-contacting sensors may also be used as shown and described in FIGS. 14*b* and 14*c*. Moreover, although the sensor wand can also act to prevent the topmost sheet from flying off the stack, a non-contacting sheet fly-off prevention device may be used, as shown, for example, in the embodiment of FIGS. 14*c* and 14*d*.

Returning now to the embodiment of the sensor 320 shown in FIG. 11, the sensing element 322 is configured to pivot between a high position 332 (shown in dotted line) and a low position 334 (shown in dashed line) as it tracks the topmost sheet 110 of the stack 108. The sensing element 322 pivots about a fulcrum 336 that is defined in the support structure 330. On a free end thereof, the sensing element 322 forms a curved contact portion 338 that is in contact with the uppermost sheet of the stack 108 (see FIG. 9). At its opposite end, the sensing element 322 includes a flag 340, which is a rectangular element disposed to follow the pivoting motion of the sensing element 322.

Two optical sensor switches are disposed on the support structure 330 such that the flag 340 blocks a respective switch's line of sight when the sensing element 322 is at its high or low position 332 or 334 respectively. More specifically, in the orientation of FIG. 11, a first optical switch 342 is blocked by the flag 340 when the sensing element 322 is at the high position 332, while a second optical switch 344 is blocked by the flag 340 when the sensing element 322 is at the low position 334. In each instance, the first or second optical switch 342 and 344 may be a transceiver of an optical beam that is disposed to provide a signal to the controller 328 when the respective optical beam is interrupted by the flag 340, thus indicating that the flag 340, and therefore the sensing element 322 and ultimately the uppermost sheet 110 of the stack 108, is disposed at one of two predetermined heights.

It should be appreciated that the optical sensors may be replaced by any other suitable sensor arrangement, such as mechanical or electrical switches, proximity sensors, a rotary encoder at the fulcrum, and the like. It should also be appreciated that the sensing element 322 is configured to have more weight on the sensing side of the fulcrum than on the flag side of the fulcrum such that it may track the position of the stack. Alternatively, resilient elements or other biasing arrangements may be used to insure that the curved contact portion 338 remains in contact with the uppermost sheet 110 of the stack 108.

Returning now to the embodiment shown in FIGS. 8-10, particular reference is made to FIG. 8, which illustrates a condition in which the topmost sheet 110 of the stack 108 is raised by the lift table 112 to substantially the height of the plane 124. In this condition, the blower 102 is not yet active and is configured to be at a substantially horizontal orientation. The lifting of the stack 108 to this position is accomplished by driving means of the table 112 that are responsive to command signals from the controller 328. The determination of the position of the stack 108 is made based on a signal from the step height sensor 320.

As in the previous embodiment, the position or, in this case, the orientation of the blower 102 may be determined based on a balance of forces or moments acting on the blower frame 302. More specifically, as shown in FIG. 8, the weight of the blower, W, imparts a moment tending to tilt the blower 102 in a clockwise direction. When the blower 102 is activated, the air stream 126 begins to aerate and lift the uppermost sheets 110 of the stack 108 as previously described. This causes the upper sheets 110 to be raised, as shown in FIG. 10, and also imparts a lifting force that has a vertical component, Fb, which pushes the lever 318 upwards. The upward motion of the lever 318 under the force Fb imparts a moment that tilts the blower 102 in a counterclockwise direction. This rotational displacement of the blower 102 in turn causes the tension spring 312 to extend and provide a spring force, Fs, which creates a moment tending to push the blower 102 in a clockwise direction. The upward motion of the topmost sheet 110 of the stack 108 also causes an upward displacement of the sensing element 322, which begins to move towards the high level switch 326. During this condition, after the blower 102 has been activated, if the lift of the aerated sheets is not sufficient to cause a vertical displacement of the step height sensor 320 that activates the high level switch 326, the lift table 112 will be caused to begin lifting the stack 108. The lift table 112 will continue lifting the stack 108 until the high level switch 326 has been tripped.

When the stack 108 has been sufficiently raised such that the aerated topmost sheets 110 cause the sensing element 322 to activate the high level switch 326, a signal is provided to the controller 328 to halt the lift table 112. This condition is shown in FIG. 10. Thereafter, a feeding device (not shown) begins retrieving sheets 110 from the stack 108 and the stack feeding process is initiated.

During the feeding process, un-inflated sheets 110 from the stack 108 become inflated to supplement the inflated sheets 110 at the upper part 106 of the stack 108 as sheets are removed. The overall height of the uppermost sheet 110 of the stack 108 is progressively at a lower height as successive sheets 110 are continuously removed. During this time, the step height sensor 320 is lower than the activation position for the high level switch 326 but may not yet have reached the activation position for the low level activation switch 324, as shown in FIG. 9. When the stack height eventually decreases to the point where the low level switch 324 is activated, a signal is provided to the controller 328 to activate the lift table and lift the remaining stack 108 up to a height sufficient to once again activate the high level switch 326, and the process is repeated until the stack is depleted. In this way, the feeding process from the stack 108 may continue substantially uninterrupted as long as the stack 108 has not been depleted.

During the successive raising and lowering of the stack 108 in the fashion described while the feeding process is ongoing, the pivotal motion of the blower 102 due to the pin joint 306 enables the continuous aeration of the sheets 110 without interruption. In one embodiment, the power provided to drive the blower 102 may be adjusted depending on its orientation and/or position to provide for uniform aeration of the stack for various operating conditions.

In this embodiment, the height at which the high level switch 326 is activated may be too high for the feeding process to be efficiently conducted insofar as a gap 348 may be created between inflated and un-inflated sheets of the stack 108, as shown for illustration in FIG. 10. The presence of this condition may be rectified by halting the feeding process long enough to lower the lift table 112 after the high level switch 326 has been activated by a predetermined extent by the controller 328. In this way, as shown in FIG. 9, the gap 348 may be eliminated and the feeding process may proceed or continue.

As previously discussed, a lower bumper 316 is employed to limit the upward tilt of the blower 102. In certain conditions, for example, during the lifting of the uppermost sheet 110 of the stack 108 by a feeding head, the blower 102 may become temporarily lifted as the uppermost sheet is pulled off the stack 108 and pulls, for example, by friction, the lever 318 upwards. This temporary raising of the blower 102 will increase the angle of incidence of the air stream 126, which may in turn tend to concentrate the inflated sheets 110 below the blower lever 318 and tend to generate a gap similar to the gap 348 shown in FIG. 10. To avoid such conditions, the lower bumper 316 limits excessive increases in the angle of the blower 102. Correspondingly, the upper hanger 314 may also act as a bumper to, in addition to the stop 310, limit the downward tilt of the blower 102 and insure against a condition in which the blower 102 would be blowing the sheets 110 in a downward direction toward the stack 108.

An alternative embodiment of an aeration device 400 is shown in FIGS. 13-16. The aeration device 400 is well suited for heavy and/or large sheets and includes several side blowers 102 arranged around the stack 108. As shown, for example, in the top view of FIG. 15, a plurality of blowers 102, in this case ten blowers 102, are arranged around the stack 108. It should be appreciated that fewer or more blowers 102 may also be used depending on the size and weight of the sheets in the stack 108.

Figure 13:
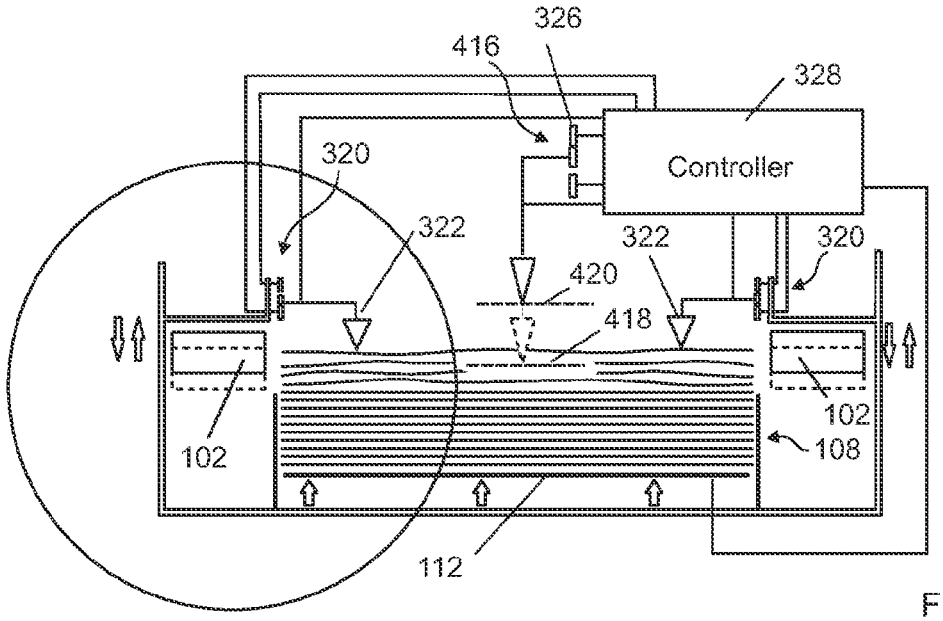
FIGS. 13-16 are various views of a fourth embodiment of a stack feeding aeration device in accordance with the disclosure.
Figure 15:
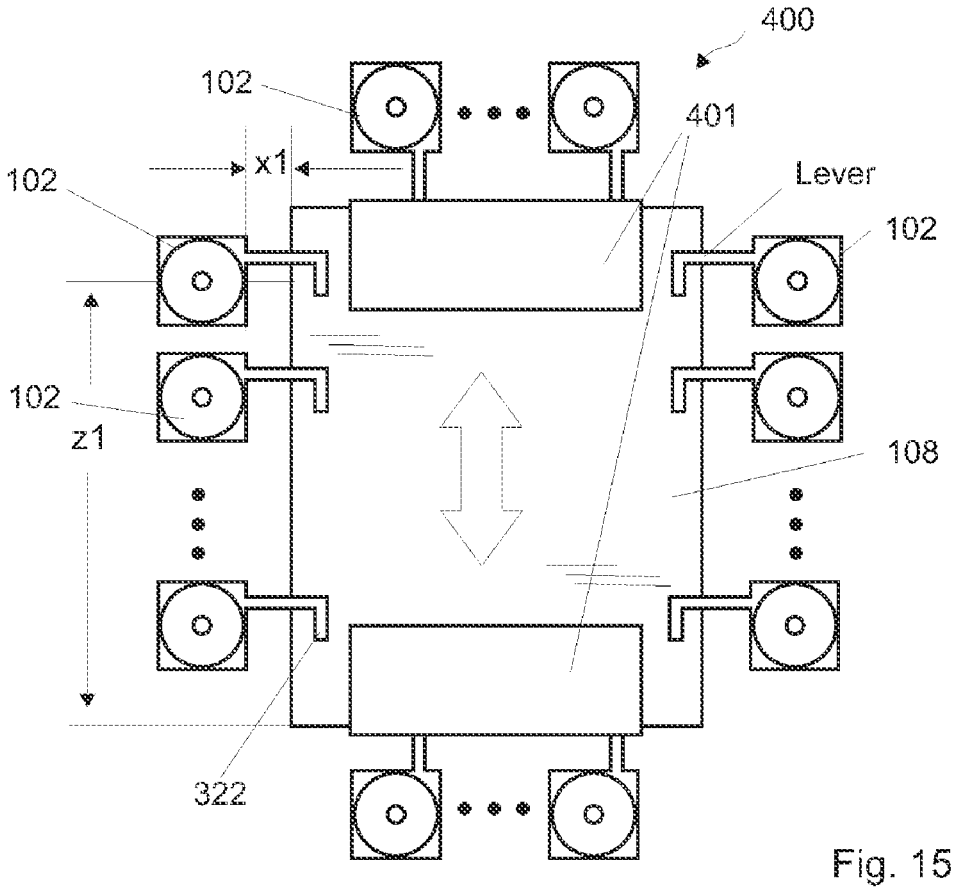
Figure 16:
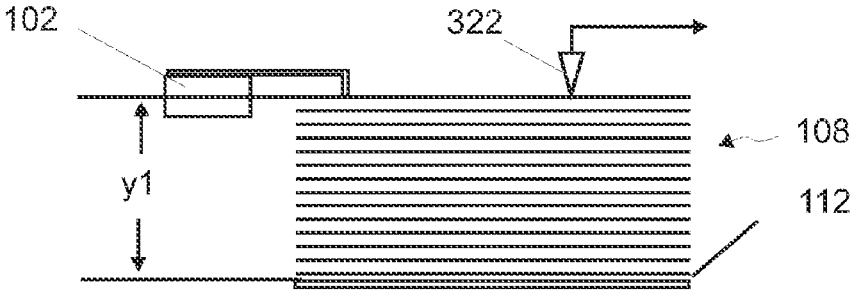

Each blower 102 may have the same or a similar mounting and orientation arrangement as those described above. In the illustrated embodiment, the blowers 102 are mounted and include an orientation structural arrangement in accordance with an additional embodiment. More specifically, each of the blowers 102 is configured to be moveable in three directions independently of the others, while the motion of each of the blowers 102 is controlled by the electronic controller 328, as shown in FIG. 13. Each blower 102 is therefore selectively displaceable along the width (x1), length (z1) and height (y1) dimension of the stack 108 as shown in FIGS. 15 and 16. Motion along each of these three directions may advantageously position the required number of blowers in appropriate positions around the stack 108 in response to commands from the controller 328. Moreover, the distance between the outlet of each blower 102 and the side of the stack 108 may be adjusted in this fashion.

As shown in FIG. 13, each blower 102 may be associated with a dedicated step height sensor 320, which in this embodiment is configured to provide signals to the electronic controller 328 that are indicative of the relative height of a portion of the topmost sheet 110 of the stack 108 that is in the vicinity of the blower 102. In other words, the plurality of blowers 102 operates in conjunction with a corresponding plurality of step height sensors 320. In this way, the electronic controller 328 may continuously, or as necessary, adjust the height, y1 (FIG. 16), of each blower 102 based on the signal received from each dedicated step height sensor 320 for optimal operation of one or more feeding heads 401 (FIG. 15) retrieving sheets from the stack 108.

Figure 14A:
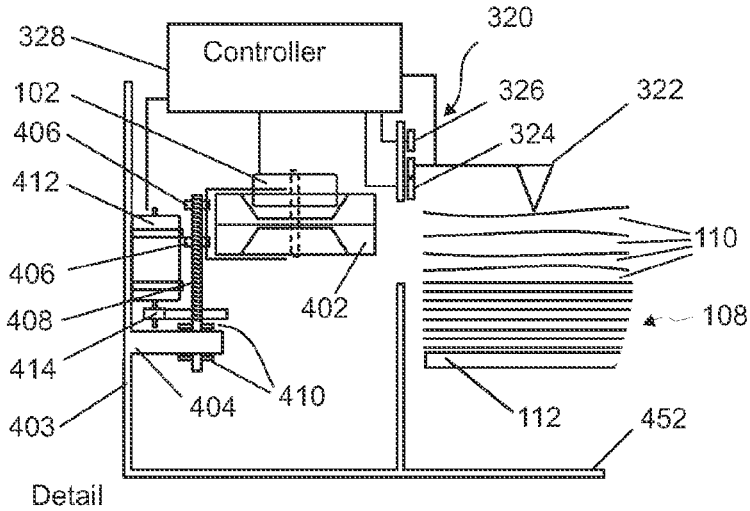
Figure 14B:
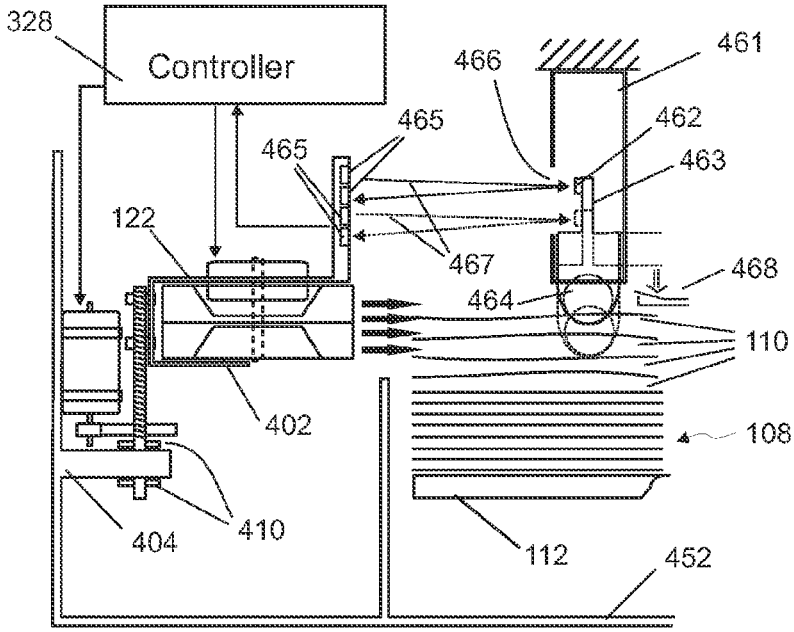
Figure 14C:
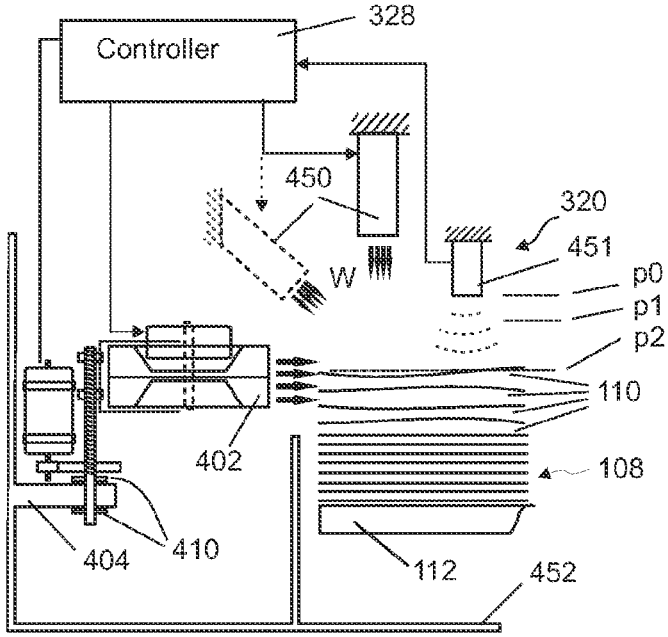

Although any known arrangement and suitable configuration may be used in the lengthwise and widthwise motion of the blowers 102, one possible embodiment for the selective positioning of each of the blowers 102 in a vertical direction is shown in FIGS. 14*a*-14*c*. In the illustrated embodiment, the blower 102 is mounted on a frame 402 that is constrained for vertical sliding motion relative to a vertical support member 403. The vertical support member 403 has a horizontally extending support arm 404. The frame 402 includes two threaded nuts 406 rigidly connected thereto and threadably disposed along and around a threaded rod 408. The threaded rod 408 is rotatably disposed on the support arm 404 by bushings 410. An electric lift motor 412 has an output shaft associated with a drive mechanism 414 that is connected to and disposed to cause the rotation of the threaded rod 408. In this way, the selective bidirectional activation of the lift motor 412 is configured to raise or lower the blower 102 in response to command signals from the electronic controller 328. It is noted that signals indicative of the vertical height of the blower 102 may be provided to the electronic controller 328 in any known fashion. In the illustrated embodiment, the lift motor 412 is a stepper motor having a rotary encoder (not shown) integrated therewith such that the rotational displacement and position of the output shaft of the lift motor 412 and, thus, the vertical position of the blower 102 may be known at all times.

An alternative embodiment of a two step height regulation method of an aeration device for a feeder is shown in FIG. 14*b*. Here, a plunger 463 with a reflector piece 462 at its upper end is configured to contact the top or exposed surface of the uppermost sheet of the stack by means of, in the illustrated embodiment, a generally spherically shaped pin 464. The pin 464 is disposed at the lower end of the plunger 463 and is also partially incorporated in the plunger 463. The pin 464 is spherically seated within the plunger 463 while a tip portion of the pin 464 is in contact with the stack.

As shown, the plunger 463 along with the ball pin 464 are vertically movable within a tube 461 such that they track the height of the stack during the feeding process. The tube 461 is hollow and fixedly mounted to the chassis 452. At one end, the tube 461 an opening 466 directed towards a pair of optical transceivers 465 that are positioned opposite to the opening 466. The optical transceivers 465 are fixedly mounted to the frame 402 of the side blower. Each of the optical transceivers 465 is equipped with a transmitting and receiving element integrated therewith. During operation, each transmitting element transmits a beam 467, which causes a signal to be generated when the beam is received by a corresponding receiving element. The transmitting and receiving elements of the transceivers 465 are configured to provide step-like information on the position of the plunger 463 or, stated alternatively, the transceivers 465 are arranged in stages.

These stages are arranged one upon the other so a first stage is positioned vertically below a second transceiver stage. Within each stage, the transmitter is positioned on top of the receiver section and the corresponding light beam 467 of each stage is aimed towards the opening 466 of the tube 461. During operation, one of the emitted beams 467 of either the upper or lower transceiver stage will be reflected by a reflector 462 and will be detected in the receiving part of the relevant transceiver 465. The information consequently is routed to the controller.

When the height position of the uppermost substrate on the stack becomes lower, the plunger 463 will be lowered in turn. As a consequence eventually the light beam of the upper transceiver stage will not be reflected any more while the light beam 467 of the lower transceiver stage will start to get reflected by the reflector 462. This causes the receiving section of the lower transceiver to signal this to the controller which in turn will lower the side blower's vertical position, until there again is a response from the light beam of the upper stage. When with a further decreasing stack height the plunger eventually will reach its lower end in the tube it will actuate a switch 468 which consequently will cause the controller to lift the substrate table 112 which then will enable further feeding.

Figure 14D:
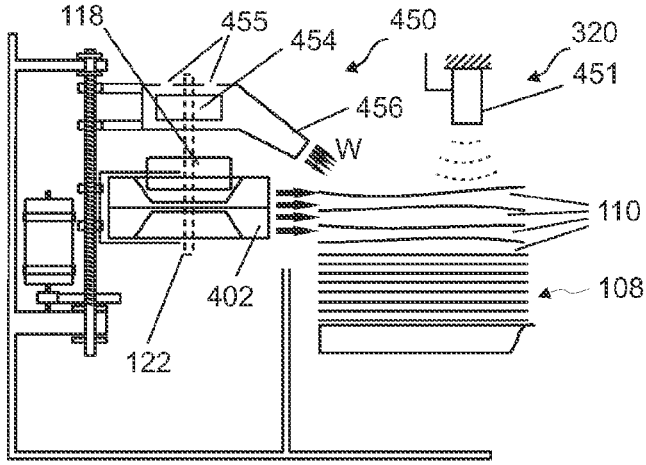
Figure 14E:
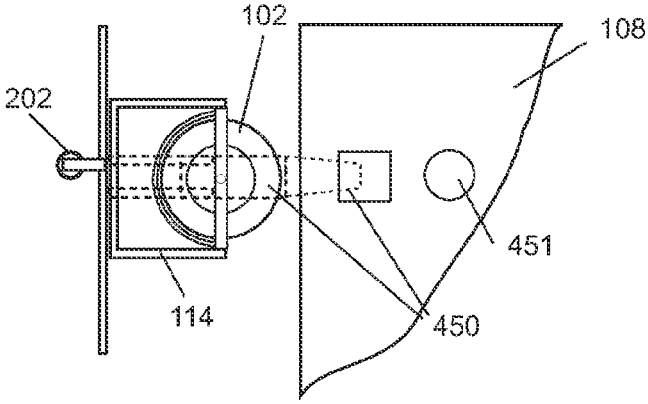

An additional alternate embodiment of a contactless height regulation component configuration is shown in FIGS. 14*c* and 14*d*. Here, a contactless proximity sensor 451 based on an ultrasonic or optical sensing device, which is positioned in the vicinity of the side blower, is fixedly mounted to part of the chassis 452 while its beam travels at a distance above the uppermost sheet of the stack. Adjacent to the sensor is an additional air source 450. The additional air source 450 provides an air stream directed towards the upper side of the uppermost sheet of the stack. The additional air source may be an additional blower or an outlet of any air source. In the illustrated embodiment, both the sensor and the air source do have fixed positions relative to the blower frame 452.

When the contactless sensor detects the vertical position of the uppermost sheet to be approaching a high position, for example, the position p1, a signal is provided to the controller. The controller in turn will operate to increase the air stream of the height limiting blower 450, e.g. by increasing its speed or by any means, to increase the airstream of the blower and thus increase the force pushing the sheet in a downward direction. In this way, the uppermost sheet 108 will be pushed down by the increased blowing force W until the sheet again is brought in a floating position in between a height range position p2 and p1. Although a direct blower is shown here, other methods of providing a downward air stream on the stack to control the height of the uppermost sheet are contemplated, such as means to modify the air stream onto the substrate by means of flaps or nozzles to increase or decrease the amount of air being pushed to the substrate, and others. In some embodiments, especially those having stacks of substrates having a weight of about 200 grams per square meter, a height limiting force may not be necessary or may be required only occasionally. In such embodiments, the height limiting blower only may be selectively activated or may be omitted.

An alternative embodiment of a height limiting, stabilizing, and/or dampening configuration for preventing the blow-off of the uppermost sheet of the stack as well as for stabilizing and dampening any undulating motion caused to the uppermost sheet by the side blower is shown in FIG. 14*d*. In this embodiment, the side blower motor 118 is used to also drive a second impeller 454 that is connected to its drive axle 122. Air ducts 456 are used to direct an airflow (W) incoming from openings 455 to the second impeller 454 towards the uppermost sheet of the stack. Both impellers 402 and 454 are fixedly coupled as they are being moved up or down on the same threaded rod 408 by lift motor 412 (as shown in FIG. 14*a*). By means of a reduced diameter of the impeller 454 and/or by the selectively limited air intake flow rate that can be achieved by adjustment of the openings 455 in the housing, the air stream (W) can be limited so as to just keep the uppermost sheet in place. Advantageously, the stabilizing air flow (W) generated by the second impeller 454 may be considered proportional to the main separating airflow generated by the main impeller 402. Based on the foregoing, the electronic controller 328 is disposed to receive a plurality of signals from the step height sensors 320 that are associated with the blowers 102 and/or 450 respectively during operation. Moreover, as before, the controller 328 is disposed to control the lifting and lowering of the stack 108 by providing appropriate commands to the lift table 112. Given the controlled vertical displacement of the blowers 102 in this embodiment as opposed to the mechanical displacement of the blower in each of the previously described embodiments, a stable control system is required. To this end, one of the step height sensors 320 may be designated in the controller 328 as the master step height sensor, the signal of which may be used to determine required lifting or lowering of not only the respective blower associated therewith, but also of the stack 108 by operation of the lift table 112.

Alternatively, an additional or dedicated step height sensor 416 may be used as the master sensor that will provide information to the controller 328 indicative of required adjustments of the lift table 112 independently of the adjustments of the blowers 102. As shown in FIG. 13, the additional step height sensor 416 may have the same or similar structural configuration as the step height sensors 320.

During operation, the lift table 112 may be lifted via the controller 328 when the feeding process is initiated until the topmost sheet of the stack 108 has reached a base position 418. The blowers 102 are then activated and cause the uppermost sheets of the stack 108 to become aerated or inflated. As previously described, the aeration of the topmost sheets of the stack 108 will increase the height of the topmost sheet, which will also independently raise each of the step height sensors 320 associated with the blowers 102.

When each of the step height sensors 320 approach their respective high level switches 326, the controller 328 provides a command signal that effects the raising of each corresponding blower 102. The raising of each corresponding blower 102 is halted when each corresponding blower 102 is at a height that is slightly higher than the uppermost sheet of the stack 108 while neither the low level or high level switches 324 and 326 of each sensor 320 is activated.

Given the large size of the sheets in the stack 108 in this embodiment, the undulating motion of the sheets during aeration will be pronounced. Nevertheless, each blower 102 is controlled by its respective step height sensor 320 to be at a height between the high and low level switches 324 and 326 independently from the other blowers 102 and also independently from the lift table 112. In this way, the blowers 102 consistently may follow the wavelike movement of the topmost sheet of the stack 108 while the appropriate average height of the stack 108 is adjusted by the additional sensor 416 to be appropriate for the feeding operation.

In the illustrated embodiment, the additional step height sensor 416 is useful in insuring that an appropriate feeding height is maintained by appropriate adjustments of the lift table 112. More specifically, in the event that inflation of the topmost sheets of the stack 108 raises the level of the topmost sheet at or beyond a maximum feeding height limit 420, the controller 328 may provide an appropriate signal to the lift table 112 to lower the stack 108 until a suitable feeding height is achieved. In this way, the controller 328 may maintain the inflated, upper part of the stack 108 above the base position 418 and below the feeding height limit 420 at all times during operation.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. An aeration device adapted to aerate one or more sheets of a stack of sheets, the aeration device comprising:

a side blower configured to selectively provide an air stream at an outlet thereof along an airstream direction so as to impinge against at least a portion of the stack and to lift an uppermost sheet of the stack;

a height detecting device configured to detect a height of the uppermost sheet of the stack; and a side blower adjustment device configured to adjust, based on an input from the height detecting device, at least one of a height of the side blower and an angle of the airstream direction as the uppermost sheet of the stack is being lifted from the stack so as to track, by the air stream, the uppermost sheet.

2. The aeration device of claim 1, further comprising a stabilizing device configured to at least one of inhibit movement of the uppermost sheet of the stack in the airstream direction, limit a height of the uppermost sheet of the stack, and dampen an undulating motion of the uppermost sheet of the stack.

3. The aeration device of claim 2, wherein the side blower adjustment device includes a control device and wherein the stabilizing device includes a top blower configured to blow air onto the uppermost sheet of the of the stack so as to provide a height limiting force, the top blower being configured to be driven by the control device.

4. The aeration device of claim 3, wherein the side blower includes a main impeller driven by a shaft, and wherein the stabilizing device includes a second impeller driven by the shaft of the side blower and configured to generate an airflow that is directed towards the uppermost sheet of the stack by a duct.

5. The aeration device of claim 2, wherein the side blower adjustment device includes a control device configured to drive the stabilizing device.

6. The aeration device of claim 1, wherein the side blower includes an impeller based radial blower.

7. The aeration device of claim 1, wherein the height detecting device includes a mechanical sensor lever configured to contact with a free end thereof the uppermost sheet and connect to the side blower at another end thereof.

8. The aeration device of claim 1, wherein the height detecting device includes a non-contacting distance sensor configured to sense the height of the uppermost sheet of the stack in the vicinity of the air stream and to provide a signal indicative of the height to the side blower adjustment device.

9. The aeration device of claim 1, wherein the side blower adjustment device includes a control device and wherein the height detecting device is contactless and configured to provide a signal to the control device.

10. The aeration device of claim 1, wherein the side blower adjustment device includes at least one of:

a lever having an end configured to contact the uppermost sheet of the stack and an end connected to the side blower, and a servo mechanical driver connected to a control device and drivable by the control device so as to adjust the height of the side blower.

11. The aeration device of claim 1, wherein the control device includes a mechanical lever connected at one end thereof to the side blower and adapted for contact with the uppermost sheet of the stack at another end thereof.

12. The aeration device of claim 1, further comprising a lift table configured to selectively adjust the height of the uppermost sheet of the stack.

13. The aeration device of claim 12, wherein the side blower adjustment device includes a control device and wherein the height detecting device comprises:

a sensing element configured to follow the uppermost sheet of the stack;

a high level switch configured to provide a high level signal to the control device when the sensing element is at a high level limit; and a low level switch configured to provide a low level signal to the control device when the sensing element is at a low level limit;

wherein the control device is configured to raise the lift table until the high level signal is provided when the low level signal has been provided during operation while the stack has not been depleted.

14. The aeration device of claim 1, further comprising a height position limiting force device for limiting the height position of the uppermost sheet, the height position limiting force device being configured to apply a force that includes a force component that acts orthogonally on the uppermost sheet of the stack in a vicinity of the height detecting device.

15. The aeration device of claim 1, wherein the side blower adjustment device comprises:

a vertical rod, the side blower being slidably disposed on the vertical rod; and a resilient element disposed to suspend at least a portion of a weight of the side blower;

wherein height changes of the uppermost sheet of the stack operate to provide corresponding vertical displacements to the free end of the lever, which is configured to provide corresponding vertical displacements of the side blower along the vertical rod.

16. The aeration device of claim 1, wherein the side blower adjustment device further comprises:

a vertical support pole having an upper hanger connected thereto;

a support member connected to and extending substantially horizontally from the vertical support pole at a location below the upper hanger;

a pin joint pivotally connecting the side blower with the support member;

a resilient element disposed between the side blower and the upper hanger, the resilient element configured to maintain the side blower at a substantially horizontal position;

wherein height changes of the uppermost sheet of the stack operate to provide corresponding vertical displacements of the free end of the lever, which is configured to provide corresponding angular displacements of the side blower by rotation of the side blower relative to the vertical support pole about the pin joint.

17. The aeration device of claim 16, further comprising a lower bumper disposed on the vertical support pole below the support member, wherein the lower bumper is configured to limit the upward angular displacement of the side blower to be below a predetermined angle.

18. The aeration device of claim 1, wherein the side blower is configured to direct the airstream so as to impinge at least partially against at least one planar side wall of the stack.

19. The aeration device of claim 1, wherein the side blower is configured to selectively adjust an air flow rate and an air velocity of the air stream such that a thickness of an air gap created between adjacent sheets in the uppermost part of the stack is selectively providable.

20. The aeration device of claim 1, wherein the stack has at least two vertical side walls that meet at a corner and wherein the side blower is configured to direct the airstream so as to impinge at least partially against at least one of the corner and one of the vertical side walls of the stacks.

21. The aeration device of claim 1, wherein the side blower adjustment device comprises:

a side blower sensing element configured to follow the uppermost sheet of the stack;

a blower high level switch configured to provide a blower high level signal to the control device when the side blower sensing element is at a high level blower limit;

a blower low level switch configured to provide a blower low level signal to the control device when the side blower sensing, element is at a low level blower limit; and a control device configured to raise the side blower until the blower high level signal is provided when the blower low level signal has been provided during operation while the stack has not been depleted.

22. The aeration device of claim 21, wherein the side blower adjustment device comprises:

a vertical support member;

a support arm connected to the vertical support member and extending substantially horizontally therefrom;

a lift motor connected to the vertical support member and having an output shaft;

a threaded rod rotatably connected to the support arm;

a drive mechanism operably disposed to transmit a rotational motion of the output shaft to the threaded rod;

at least one threaded nut threadably engaged on the threaded rod;

wherein the frame is connected to the at least one threaded nut and constrained from rotating relative to the vertical support member such that rotation of the threaded rod by the motor causes a vertical displacement of the side blower.

23. A method for aerating one or more sheets of a stack of sheets, the method comprising:

selectively providing, by a side blower, an air stream at an outlet of the side blower along an airstream direction so as to impinge against at least a portion of the stack so as to lift an uppermost sheet of the stack;

detecting, by a height detecting device, a height of the uppermost sheet of the stack; and adjusting, by a side blower adjustment device, based on an input from the height detecting device, at least one of a height of the side blower and an angle of the airstream direction as the uppermost sheet of the stack is being lifted from the stack so as to track, by the airstream, the uppermost sheet.

24. The method of claim 23, further comprising operating a stabilizing device so as to at least one of inhibit movement of the uppermost sheet of the stack in the airstream direction, limit a height of the uppermost sheet of the stack, and dampen an undulating motion of the uppermost sheet of the stack.

25. The method of claim 23, wherein the adjusting step includes dynamically and selectively positioning the side blower at more than two positions.

26. An aeration device adapted to aerate one or more sheets of a stack of sheets, the aeration device comprising:

a side blower configured to selectively provide an air stream at an outlet thereof along an airstream direction so as to impinge against at least a portion of the stack;

a height detecting device configured to detect a height of an uppermost sheet of the stack; and a side blower adjustment device configured to adjust, based on an input from the height detecting device, at least one of a height of the side blower and an angle of the airstream direction so as to track, by the air stream, the uppermost sheet, wherein the side blower adjustment device includes at least one of:

a lever having an end configured to contact the uppermost sheet of the stack and an end connected to the side blower; and a servo mechanical driver connected to a control device and drivable by the control device so as to adjust the height of the side blower.

27. An aeration device adapted to aerate one or more sheets of a stack of sheets, the aeration device comprising:

a side blower configured to selectively provide an air stream at an outlet thereof along an airstream direction so as to impinge against at least a portion of the stack, the side blower being configured to selectively adjust an air flow rate and an air velocity of the air stream such that a thickness of an air gap created between adjacent sheets at an uppermost part of the stack is selectively provided;

a height detecting device configured to detect a height of an uppermost sheet of the stack; and a side blower adjustment device configured to adjust, based on an input from the height detecting device, at least one of a height of the side blower and an angle of the airstream direction as to track, by the air stream, the uppermost sheet.

28. An aeration device adapted to aerate one or more sheets of a stack of sheets having at least two vertical side walls that meet at a corner, the aeration device comprising:

a side blower configured to selectively provide an air stream at an outlet thereof along an airstream direction so as to impinge at least partially against at least one of the corner and one of the vertical side walls of the stack;

a height detecting device configured to detect a height of an uppermost sheet of the stack; and a side blower adjustment device configured to adjust, based on an input from the height detecting device, at least one of a height of the side blower and an angle of the airstream direction so as to track, by the air stream, the uppermost sheet.

* * * * *